US008544770B2

(12) United States Patent
Limmer et al.

(10) Patent No.: US 8,544,770 B2
(45) Date of Patent: Oct. 1, 2013

(54) SPRAY HOLE PROFILE

(75) Inventors: Andrew J. Limmer, Bury St. Edmunds (GB); Ricardo Pimenta, Epsom (GB); Malcolm David Dick Lambert, West Wickham (GB); Celia C. Soteriou, Lyndhurst (GB)

(73) Assignees: Delphi Technologies, Luxembourg (LU); Holding S.arl, Luxembourg (LU)

( * ) Notice: Subject to any disclaimer, the term of this patent is extended or adjusted under 35 U.S.C. 154(b) by 591 days.

(21) Appl. No.: 12/215,375

(22) Filed: Jun. 26, 2008

(65) Prior Publication Data

US 2009/0020633 A1 Jan. 22, 2009

(30) Foreign Application Priority Data

Jun. 26, 2007 (GB) ..... 0712403.5

(51) Int. Cl.
*B05B 1/30* (2006.01)
*B05B 1/18* (2006.01)
*F02M 51/00* (2006.01)

(52) U.S. Cl.
USPC ..... 239/584; 239/567; 239/589.1; 123/525

(58) Field of Classification Search
USPC ..... 239/533.3, 548, 567, 584, 589, 589.1, 239/DIG. 3; 123/525, 526, 527, 528, 529; 60/39, 465, 49, 39.77, 249, 39.49
See application file for complete search history.

(56) References Cited

U.S. PATENT DOCUMENTS

| | | | | |
|---|---|---|---|---|
| 406,978 | A | 7/1889 | Wallace | |
| 5,685,485 | A * | 11/1997 | Mock et al. | 239/102.2 |
| 6,616,071 | B2 * | 9/2003 | Kitamura et al. | 239/533.12 |
| 6,644,565 | B2 * | 11/2003 | Hockenberger | 239/533.2 |
| 6,708,905 | B2 * | 3/2004 | Borissov et al. | 239/584 |
| 7,191,961 | B2 | 3/2007 | Okamoto et al. | |
| 7,438,241 | B2 * | 10/2008 | Goenka et al. | 239/533.12 |
| 2001/0025892 | A1 | 10/2001 | McCoy et al. | |

FOREIGN PATENT DOCUMENTS

| | | |
|---|---|---|
| JP | 64-36973 | 2/1989 |
| JP | 5-296123 | 11/1993 |
| JP | 9-209876 | 8/1997 |

(Continued)

OTHER PUBLICATIONS

UK Combined Search and Examination Report under Sections 17 & 18(3) dated Oct. 5, 2007.

(Continued)

*Primary Examiner* — Len Tran
*Assistant Examiner* — Justin Jonaitis
(74) *Attorney, Agent, or Firm* — Mark H. Svoboda

(57) ABSTRACT

A fuel injector for an internal combustion engine comprising a nozzle body having at least one spray hole. The at least one spray hole has a hole entry on the inside of the nozzle body and a hole exit on the outside of the nozzle body. The spray hole is provided with a hole entry section which, starting from the hole entry, has a flow area which decreases from a relatively larger flow area at the hole entry to a relatively small flow area at the intersection between the end of the hole entry section and the start of a hole exit section. The hole exit section, starting from the intersection with the hole entry section, has a flow area which increases from a relatively small flow area at the intersection with the hole entry section to a relatively larger flow area at the hole exit.

10 Claims, 2 Drawing Sheets

(56) References Cited

FOREIGN PATENT DOCUMENTS

| | | |
|---|---|---|
| JP | 10-54330 | 2/1998 |
| JP | 2002-527678 | 8/2002 |
| JP | 2003-120472 | 4/2003 |
| JP | 2004-332657 | 11/2004 |
| JP | 2005-330915 | 12/2005 |
| JP | 2007-51589 | 3/2007 |
| WO | 00/23707 | 4/2000 |
| WO | 00/60234 | 10/2000 |
| WO | 02/063161 | 8/2002 |
| WO | 02/070178 | 9/2002 |
| WO | 2005/049273 | 6/2005 |

OTHER PUBLICATIONS

Japan Office Action dated Jul. 5, 2010.
Japan Office Action dated Apr. 8, 2011.
Japan Office Action dated Jan. 20, 2012.
English Translation of 4th Japan Office Action.

* cited by examiner

SPRAY HOLE PROFILE

TECHNICAL FIELD

The present invention relates to a spray hole profile for use in a fuel injector for an internal combustion engine. In particular, the present invention relates to a spray hole having convergent and divergent sections.

BACKGROUND OF THE INVENTION

It has been discovered that tapered spray holes which have a diametrical cross-section that reduces in size from the inside surface of the nozzle body to the outside surface of the nozzle body, such as that described in EP 0 352 926, are prone to the formation of deposits within the hole which reduce its diameter and change its flow characteristics. The main problem with the formation of deposits is that the maximum flow rate through the spray hole is reduced and this is detrimental to the performance of the engine into which the injector is installed. Consequently, it is desired to have an improved design which prevents any reduction in the flow rate.

SUMMARY OF THE INVENTION

Accordingly, the present invention provides a fuel injector for an internal combustion engine comprising a nozzle body having at least one spray hole, wherein the at least one spray hole has a hole entry on the inside of the nozzle body and a hole exit on the outside of the nozzle body and the spray hole is provided with a hole entry section which, starting from the hole entry, has a flow area which decreases from a relatively larger flow area at the hole entry to a relatively small flow area at the intersection between the end of the hole entry section and the start of a hole exit section, wherein the hole exit section, starting from the intersection with the hole entry section, has a flow area which increases from a relatively small flow area at the intersection with the hole entry section to a relatively larger flow area at the hole exit. The described spray hole profile improves the fuel flow characteristics through the spray hole and thus improves the efficiency of the nozzle.

Preferably, the hole entry section and the hole exit section have a substantially circular cross-section and the diameters of the hole entry section and the hole exit section each vary in a substantially linear relationship with the distance along the respective section.

Preferably, the hole entry section reduces in diameter from the hole entry towards the intersection with the hole exit section and the hole exit section increases in diameter from the intersection with the hole entry section towards the hole exit, such that the hole entry section has a convergent, substantially conical taper, and the hole exit section has a divergent, substantially conical taper.

Alternatively, the diameter of the hole entry section and the hole exit section may vary in a non-linear relationship with the distance along the respective section. For example, the hole entry section and the hole exit sections may be continuously curved and have a circular cross-section such that they are trumpet shaped.

It is envisaged that the hole entry section and/or the hole exit section may have a non-circular cross-section, for example a square cross-section. In such cases the cross-sectional dimension, in the case of a square the length of the sides of the square, may vary in a substantially linear or a non-linear relationship, with the distance along the respective section.

Preferably, the hole entry and the hole exit are provided with a radius. The provision of a radius improves the flow characteristics of fuel passing through the spray hole.

Preferably, the intersection between the hole entry section and the hole exit section is provided with a radius. The provision of a radius removes the sharp edge that would otherwise exist at the intersection and hence improves the flow characteristics of fuel passing through the spray hole.

Preferably, the length (LN) of the hole exit section is up to 30% of the length (L) of the spray hole. Ideally, the length (LN) of the hole exit section (17) may be between 15% and 25% of the length (L) of the spray hole. Preferably, the diameter (D) of the hole exit is up to 40% larger than the diameter (D2) at the intersection between the hole entry section and the hole exit section. More preferably, the diameter (D) of the hole exit is between 20% and 30% larger than the diameter (D2) at the intersection between the hole entry section and the hole exit section. Preferably, the diameter (D1) of the hole entry is 1.5 to 2.0 times larger than the diameter (D2) at the intersection between the hole entry section and the hole exit section. The ratios and dimensions cited above are advantageous because they produce the best conditions for obtaining low emissions characteristics whilst enabling the effective prevention of deposit formation, by the deliberate re-introduction of cavitation.

According to a second aspect of the present invention there is provided a method of forming a spray hole in a fuel injector utilising an abrasive honing process in which a fluid carrier which holds abrasive media is at one time passed through the spray hole in a direction from the hole entry towards the hole exit and at another time is passed in a direction from the hole exit towards the hole entry.

Preferably, the carrier is a paste. For example, the honing process may an abrasive paste honing process in which a high viscosity paste carrying an abrasive media is forced through the spray hole under pressure.

Alternatively, the carrier may be an oil or any other suitable fluid. For example, the abrasive honing process may be a hydro-erosive honing process or a hydro-erosive grinding process in which a lower viscosity carrier, such as water, holds the abrasive media and is forced through the spray hole under pressure.

As a further alternative a laser erosion or electrical discharge machining process may be used.

BRIEF DESCRIPTION OF THE DRAWINGS

A preferred embodiment of the present invention will now be described with reference to the accompanying drawings in which.

BEST MODE FOR CARRYING OUT THE INVENTION

Figure 1:
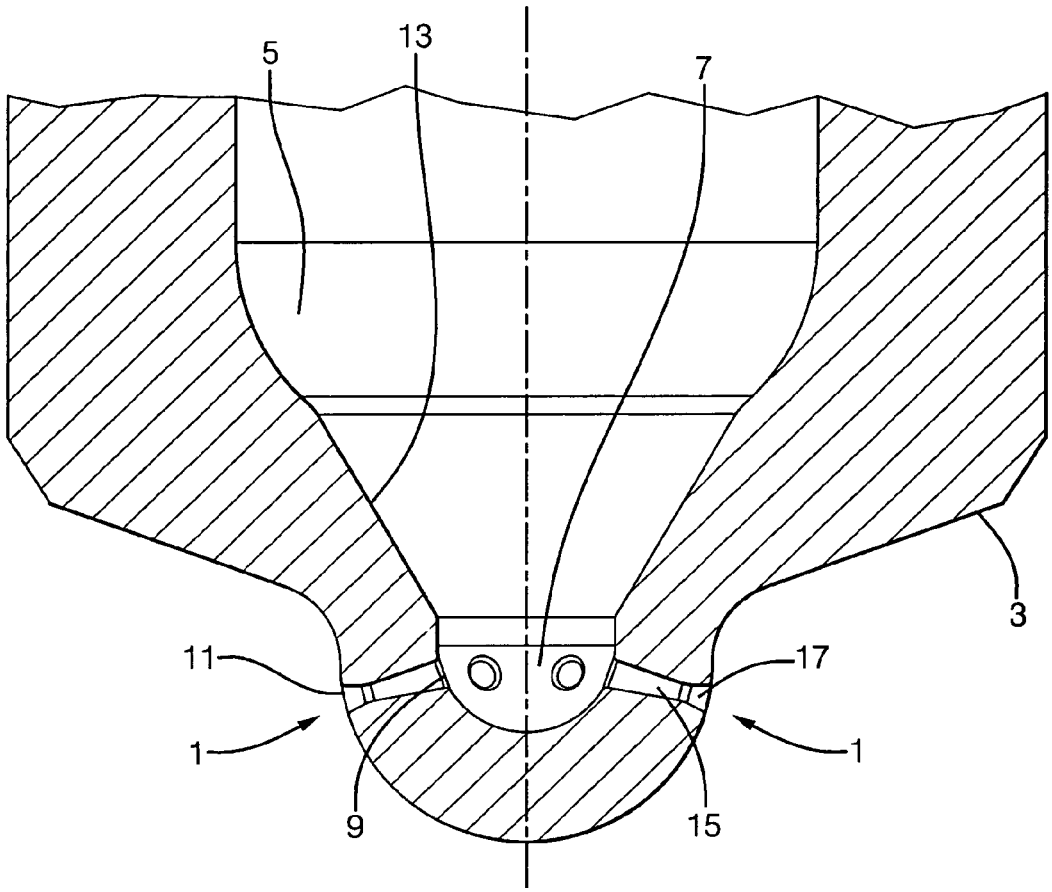
FIG. 1 is a schematic cross-sectional view of the tip of a nozzle body incorporating a spray hole according to the present invention, in which the dimensions, radii and angles have been exaggerated for ease of understanding.

FIG. 1 is a cross-sectional view of the tip portion of a fuel injector nozzle having six spray holes 1 according to the present invention (four of which are shown). The tip portion comprises a hollow generally cylindrical nozzle body 3 which defines an internal fuel delivery chamber 5 which terminates at the tip portion of the injector in a sac 7. Each spray hole 1 has a hole entry 9 located in the sac 7 and a hole exit 11 located on the external surface of the nozzle body 3, so that fuel contained with the delivery chamber 5 can be injected out of the nozzle. In order to control injection of the fuel a valve needle (not shown) is provided which is axially moveable within the chamber 5 and which in a first position seals against a valve seat 13 defined by the walls of the fuel delivery chamber 5, adjacent to the tip portion of the injector nozzle, in order to prevent fuel injection, and which is moveable away from the valve seat 13 in order to initiate fuel injection through the spray holes 1.

Figure 2:
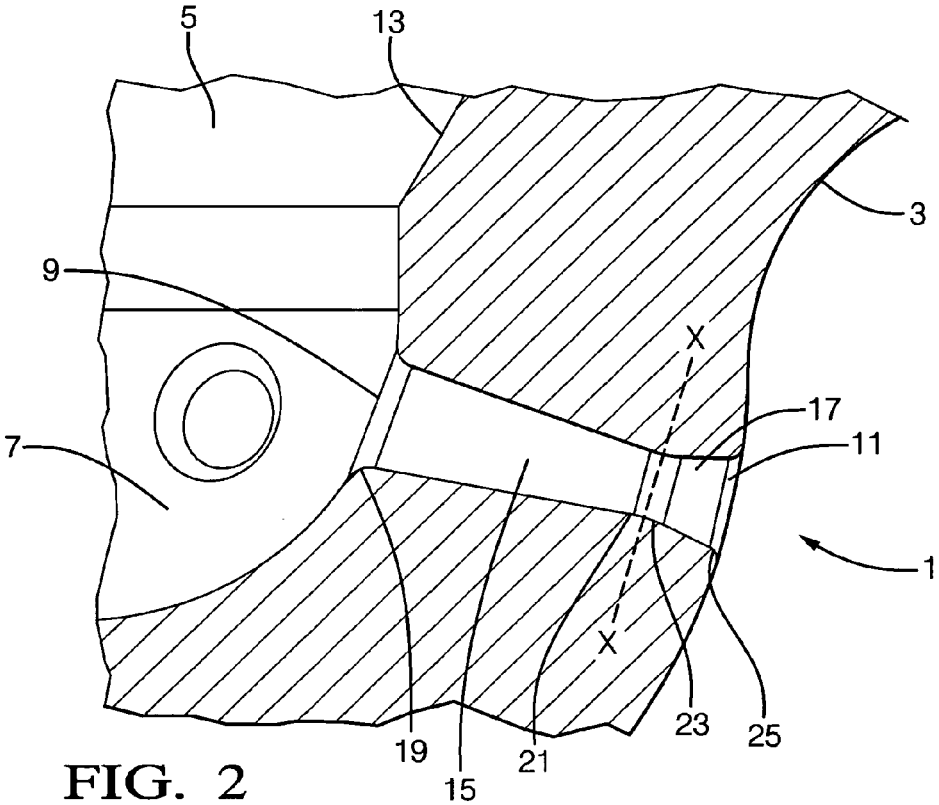
FIG. 2 is an enlarged cross-sectional view of the spray hole of FIG. 1.

A spray hole 1 according to the present invention is illustrated in greater detail in FIG. 2. The spray hole 1 can be divided along its length from hole entry 9 to hole exit 11 into 2 sections, a positively tapered hole entry section 15, to the inward side of line X-X and a negatively tapered hole exit section 17, to the outward side of line X-X. In this description the positive sense means a reduction in diameter in the direction of fuel injection, i.e. from the sac 7 to the outside of the nozzle. The negative sense means a reduction in diameter in the opposite direction.

Both the hole entry section 15 and the hole exit section 17 are frustoconical and are provided at each end with a radius. The hole entry section 15 is provided with a positive radius 19 at its end adjacent to the hole entry 9, and this joins section 15 to the wall of the sac 7. At the other end it is provided with a negative radius 21, which joins it to section 17. The terms 'positive radius' and 'negative radius' refer to radii which change the diameters of the hole entry and exit sections 15, 17 in the same sense as the positive and negative tapers, as described previously. That is, a positive radius reduces the diameter of the section 15, 17 in the direction of fuel injection and a negative radius increases the diameter of the section 15, 17 in the direction of fuel injection. The hole exit section 17 is provided with a negative radius 23 where it joins with section 15 and a positive radius 25 where it joins the external surface of the nozzle.

The aim of providing the above-described profile to a spray hole 1 is to improve the flow characteristics of fuel passing through it and to thus increase the efficiency of the fuel injection nozzle.

In the positively tapered hole entry section 15 any cavities that are created within the fuel flow, upon the fuel entering the spray hole 1, are compressed as the fuel moves along the positive, convergent, taper towards the intersection with hole exit section 17. This compression of the cavities suppresses any cavitation effects and hence improves the flow efficiency of the spray hole 1.

In the negatively tapered hole exit section 17, the cavities within the fuel are able to expand as the fuel moves along the negative, divergent, taper towards the hole exit 11. The shape of the hole exit section 17, in particular the degree of taper, is chosen so that a controlled amount of cavitation is introduced to help clean the spray hole 1. The cavities are able to expand by such a degree that they collapse. The collapse of the cavities near the walls of the hole exit section 17 dislodges any deposits on the walls and hence the spray hole 1 is cleaned.

Figure 3:
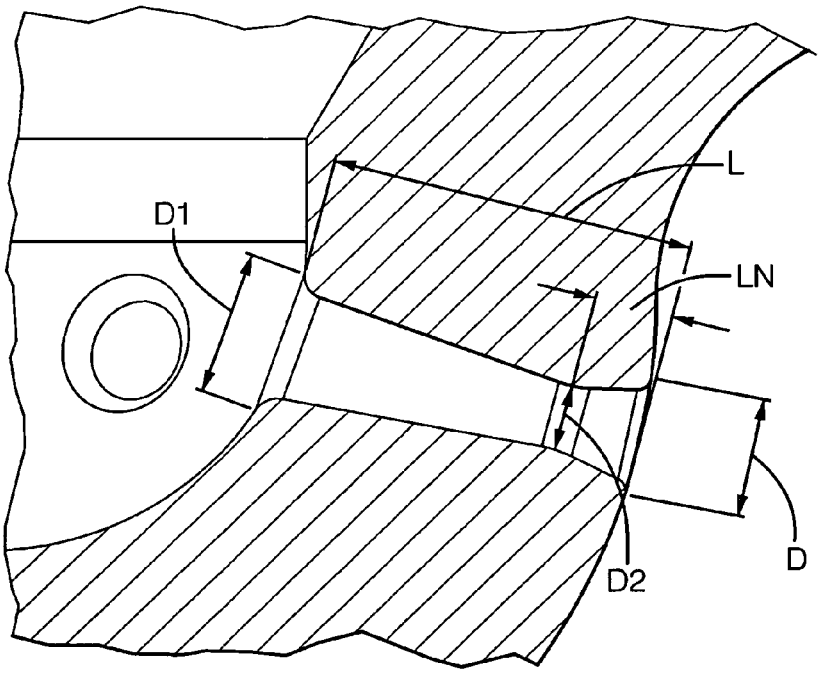
FIG. 3 is an enlarged cross-sectional view of the spray hole of FIG. 1 with relevant dimensions marked.

In order to achieve the desired results it is required that the length of the section 17, designated by LN in FIG. 3, is up to 30% of the length of the spray hole 1, designated by L in FIG. 3, and that the diameter of the hole exit 11, designated by D in FIG. 2, is up to 40% larger than the diameter of the spray hole 1 at the intersection of the hole entry and the hole exit sections 15, 17, designated by D2 in FIG. 3. In a preferred embodiment of the present invention the length LN is 15% to 25% of the length L and the diameter D is 20% to 30% larger than the diameter D2. Typically, the diameter, D1, of the hole entry 9 is 1.5 to 2.0 times larger than the diameter, D2, at the intersection of the hole entry section 15 and the hole exit section 17.

In one embodiment of the spray hole 1 of the present invention the diameter of the hole entry section 15 at the wall of the sac 7, designated as D1 in FIG. 3, is 0.125 mm and the positive radius provided to section 15 is 0.03 mm. The diameter, D, of the hole exit 9 is 0.155 mm and the diameter, D2, at the intersection between sections 15, 17 is 0.120 mm. The length L of the spray hole 1 is 0.6 mm and the length of section 17, LN, is 0.12 mm.

The profile of the spray hole 1 is created using an abrasive paste honing process in which an abrasive paste is forced through the spray hole 1. Conventionally, the abrasive paste is forced through the nozzle only in the direction of fuel injection, i.e. from the hole entry 9 towards the hole exit 11. This is used to create a smooth flow path, in particular the positive radius 19 on the section 15. In order to create the profile of the present invention it is additionally necessary to employ a reverse honing process in which abrasive honing paste is passed through the spray hole 1 in a direction opposite to that of fuel injection, i.e. from the hole exit 11 towards the hole entry 9, in order to create the radius 25 and the taper on the section 17. The amount of honing applied determines the size of the radii and the degree of taper imparted to the hole entry section 15 and the hole exit section 17.

The preferred embodiment of the present invention is described in reference to use in an injector having a sac 7 from which the spray holes 1 exit. Spray holes 1 according to the present invention can equally be applied to any other appropriate fuel injector, for example an injector of Valve Covers Orifice type.

The invention claimed is:

1. A fuel injector for an internal combustion engine comprising a nozzle body having at least one spray hole wherein the at least one spray hole has a hole entry on the inside of the nozzle body and a hole exit on the outside of the nozzle body, and the spray hole is provided with a hole entry section which, starting from the hole entry, has a flow area which decreases from a relatively larger flow area at the hole entry to a relatively small flow area at the intersection between the end of the hole entry section and the start of a hole exit section, wherein the hole exit section, starting from the intersection with the hole entry section, has a flow area which increases from a relatively small flow area at the intersection with the hole entry section to a relatively larger flow area at the hole exit, wherein the hole entry and the hole exit are each provided with a rounded chamfer having a radius so as to be devoid of sharp edges, and wherein the intersection between the hole entry section and the hole exit section is blended so as to define a non-angular junction.

2. A fuel injector as claimed in claim 1, wherein the hole entry section and the hole exit section have a substantially circular cross-section and the diameters of the hole entry section and the hole exit section each vary in a substantially linear relationship with the distance along the respective section.

3. A fuel injector as claimed in claim 1 wherein the length of the hole exit section is up to 30% of the length of the spray hole.

4. A fuel injector as claimed in claim 1 wherein the length of the hole exit section is between 15% and 25% of the length of the spray hole.

5. A fuel injector as claimed in claim 1 wherein the diameter of the hole exit is up to 40% larger than the diameter at the intersection between the hole entry section and the hole exit section.

6. A fuel injector as claimed in claim 1 wherein the diameter of the hole exit is between 20% and 30% larger than the diameter at the intersection between the hole entry section and the hole exit section.

7. A fuel injector as claimed in claim 1 wherein the diameter of the hole entry is 1.5 to 2.0 times larger than the diameter at the intersection between the hole entry section and the hole exit section.

8. A method of forming a spray hole in a fuel injector according to claim 1, utilizing an abrasive honing process in which a fluid carrier which holds abrasive media is at one time passed through the spray hole in a direction from the hole entry towards the hole exit and at another time is passed in a direction from the hole exit towards the hole entry.

9. A method as claimed in claim 8, in which the carrier is a paste.

10. A method as claimed in claim 8, in which the carrier is water.

* * * * *